US009204698B2

(12) United States Patent
Renner-Thomas

(10) Patent No.: US 9,204,698 B2
(45) Date of Patent: Dec. 8, 2015

(54) JEWELRY PACKAGING CASE TO KEEP JEWELRY KINKLESS AND TANGLE FREE

(71) Applicant: Nina Renner-Thomas, Roswell, GA (US)

(72) Inventor: Nina Renner-Thomas, Roswell, GA (US)

(73) Assignee: Nina Renner-Thomas, Roswell, GA (US)

( * ) Notice: Subject to any disclaimer, the term of this patent is extended or adjusted under 35 U.S.C. 154(b) by 195 days.

(21) Appl. No.: 13/998,163

(22) Filed: Sep. 30, 2013

(65) Prior Publication Data

US 2015/0090613 A1 Apr. 2, 2015

(51) Int. Cl.
*A45C 11/16* (2006.01)

(52) U.S. Cl.
CPC ..... *A45C 11/16* (2013.01)

(58) Field of Classification Search
CPC ..... A45C 11/16; A45C 11/26
USPC ..... 206/6.1, 213
See application file for complete search history.

(56) References Cited

U.S. PATENT DOCUMENTS

| | | | | |
|---|---|---|---|---|
| 1,615,324 | A * | 1/1927 | Bulova | A47F 7/03 206/301 |
| 2,327,301 | A * | 8/1943 | Davis | A47F 7/022 206/301 |
| 4,401,219 | A * | 8/1983 | Mink | A45C 7/0095 206/466 |
| 7,168,394 | B2 * | 1/2007 | Berry | A01K 27/006 119/792 |
| 7,673,744 | B1 * | 3/2010 | Henderson | A45C 11/16 206/473 |
| 8,522,964 | B1 * | 9/2013 | Pledger | A47F 7/03 206/523 |
| 2004/0154935 | A1 * | 8/2004 | Kaminski | A45C 11/16 206/6.1 |
| 2010/0200436 | A1 * | 8/2010 | Gupta | B65D 81/1075 206/205 |
| 2010/0236287 | A1 * | 9/2010 | Summerford | A44C 15/005 63/1.12 |
| 2012/0241329 | A1 * | 9/2012 | Gaspari | A45C 11/26 206/6.1 |
| 2015/0090613 | A1 * | 4/2015 | Renner-Thomas | A45C 11/16 206/6.1 |

* cited by examiner

*Primary Examiner* — Steven A. Reynolds
*Assistant Examiner* — King M Chu

(57) ABSTRACT

A method of keeping necklaces completely kink and tangle free. This device will allow the carrier to port their thinnest necklaces or bracelets with the accompanying ring and earrings from place to place and then to extract it whenever, wherever, with absolutely no kinks.

9 Claims, 15 Drawing Sheets

Note * represents the multiple component 102

JEWELRY PACKAGING CASE TO KEEP JEWELRY KINKLESS AND TANGLE FREE

BACKGROUND

In recent years "we buy gold" have become increasingly popular. And as the price of gold rises, people contemplate selling their tangled and mangled gold items rather than incur the cost to detangle or even waste their time detangling. Jewelry should be saved and kept as an heirloom; passed from generation to generation. Passed in mint condition.

BRIEF SUMMARY OF THE INVENTION

A method of keeping necklaces completely kink and tangle free. This will be available in multiple colors and designs each having a slightly different function (e.g. from single necklace/bracelet carriers to multi-bracelets or necklace carriers).

BRIEF DESCRIPTIONS OF THE DRAWINGS

DETAILED DESCRIPTION OF THE INVENTION

Figure 1:
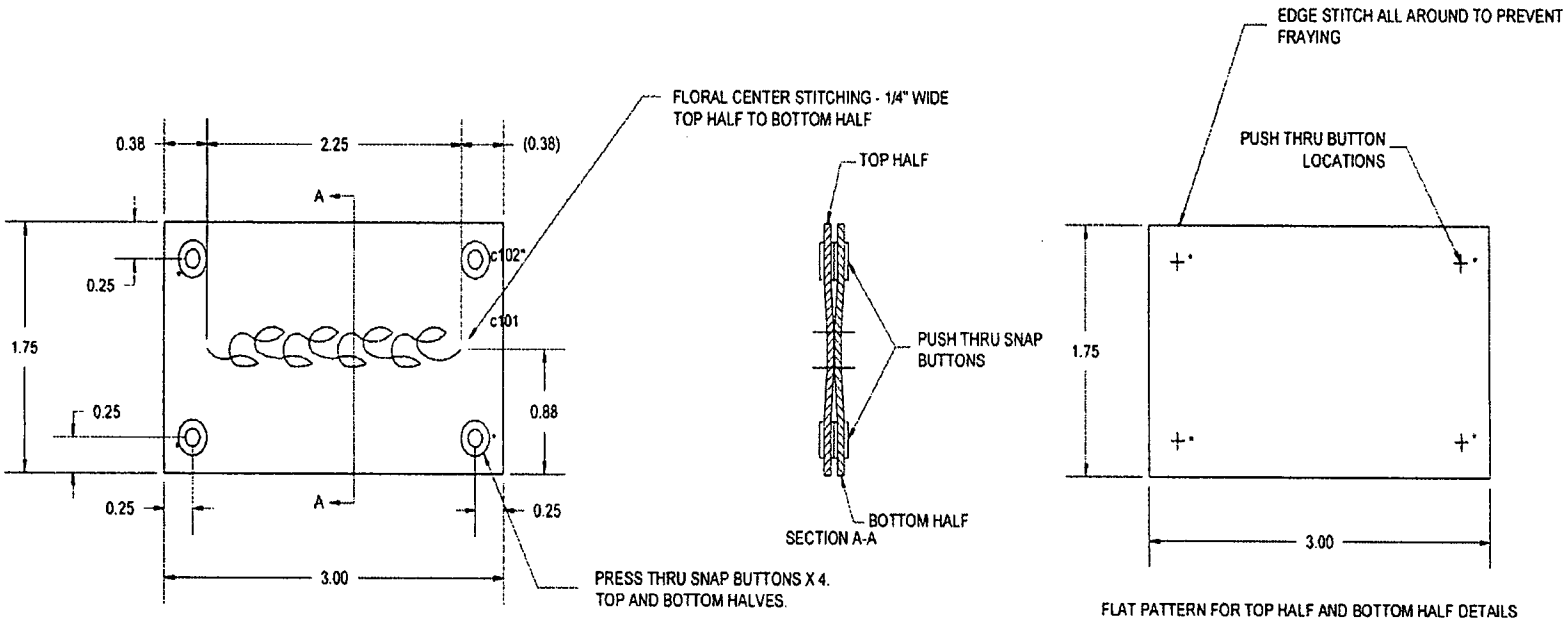
FIG. 1 represents front and back portions of the Jewelry Packaging Case used for 6" bracelets.

FIG. 1 represents front and back portions of the Jewelry Packaging Case used for bracelets (6") and it contains component 101 (c101) which is the central stitch and components 102 (c102), four snap fasteners.

Figure 2:
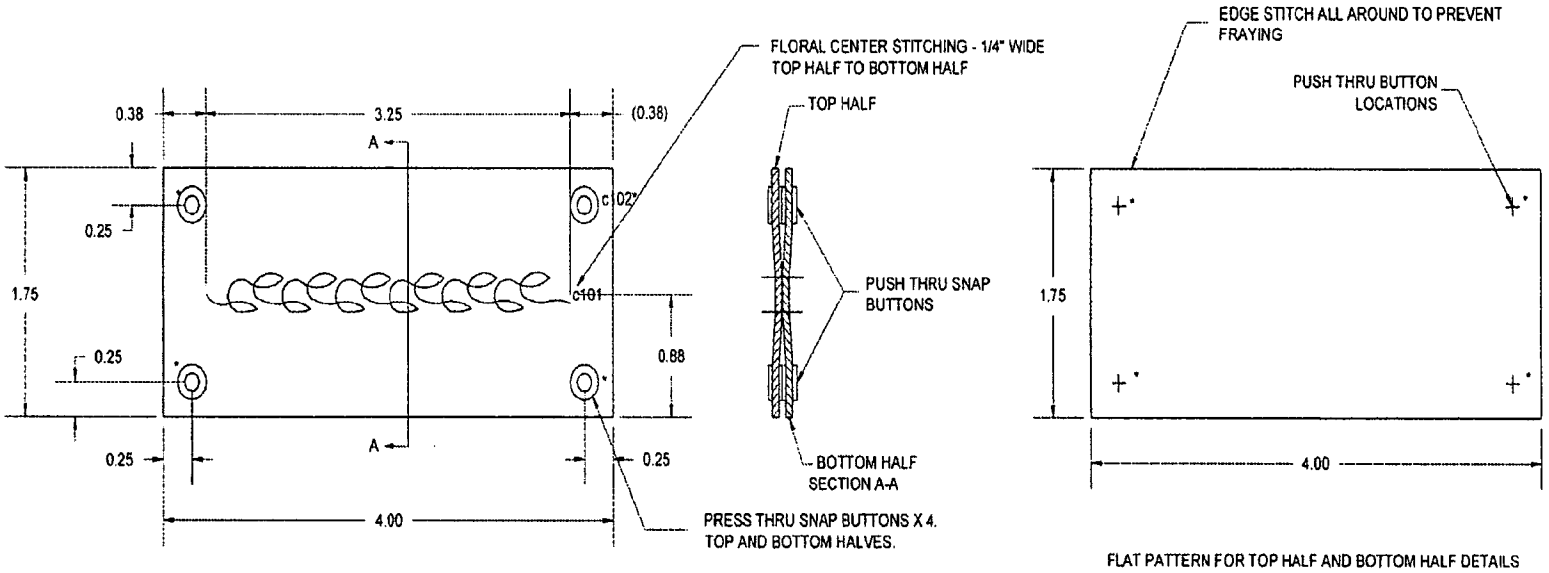
FIG. 2 represents front and back portions of the Jewelry Packaging Case used for 8" bracelets.

FIG. 2 represents front and back portions of the Jewelry Packaging Case used for bracelets (8") and it contains component 101 (c101) which is the central stitch and components 102 (c102), four snap fasteners.

Figure 3:
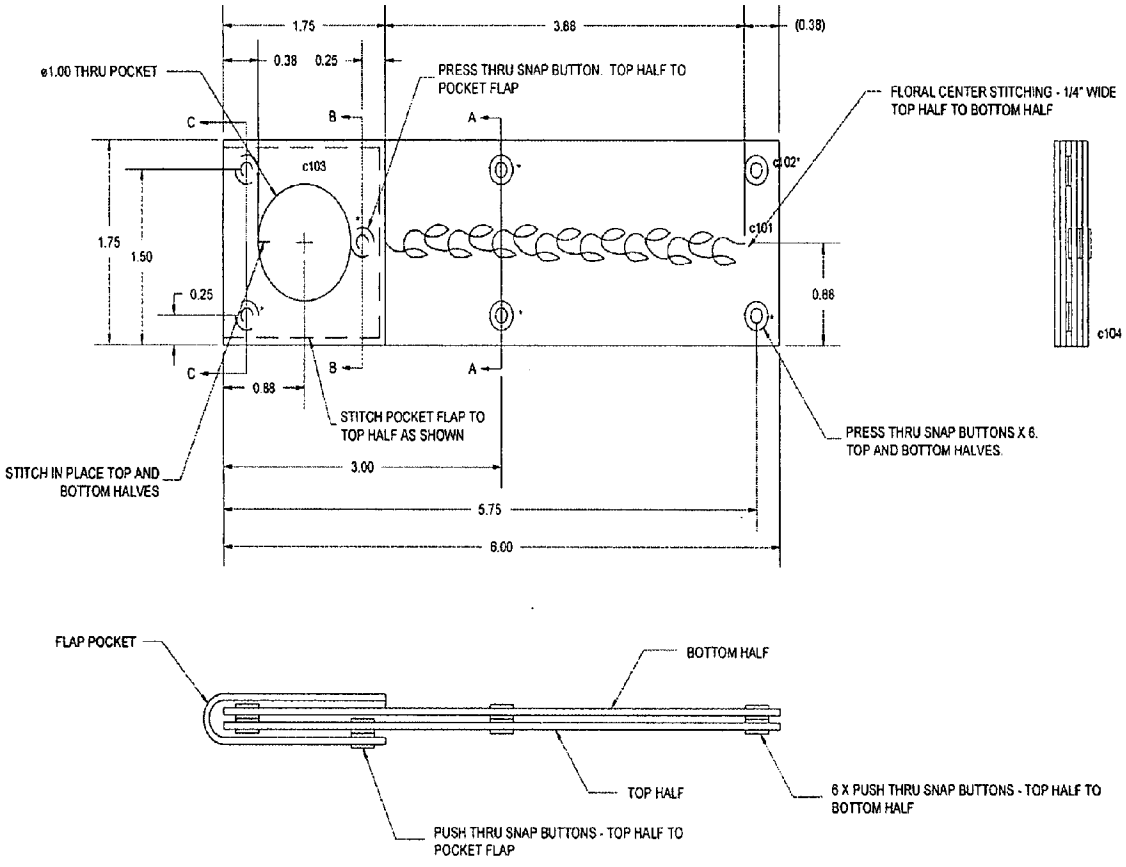
FIG. 3 represents front portion of the Jewelry Packaging Case for 12" necklace.

FIG. 3 represents front and side portions of the Jewelry Packaging Case for necklace (12") and it contains component 101 (c101) which is central stitch and Component 102 (c102), seven snap fasteners and component 103 (103), a pocket with clear plastic front to keep pendant and other small items. This also includes component 104 (c104) that represents the compacted view of the Kinkless necklace.

Figure 4:
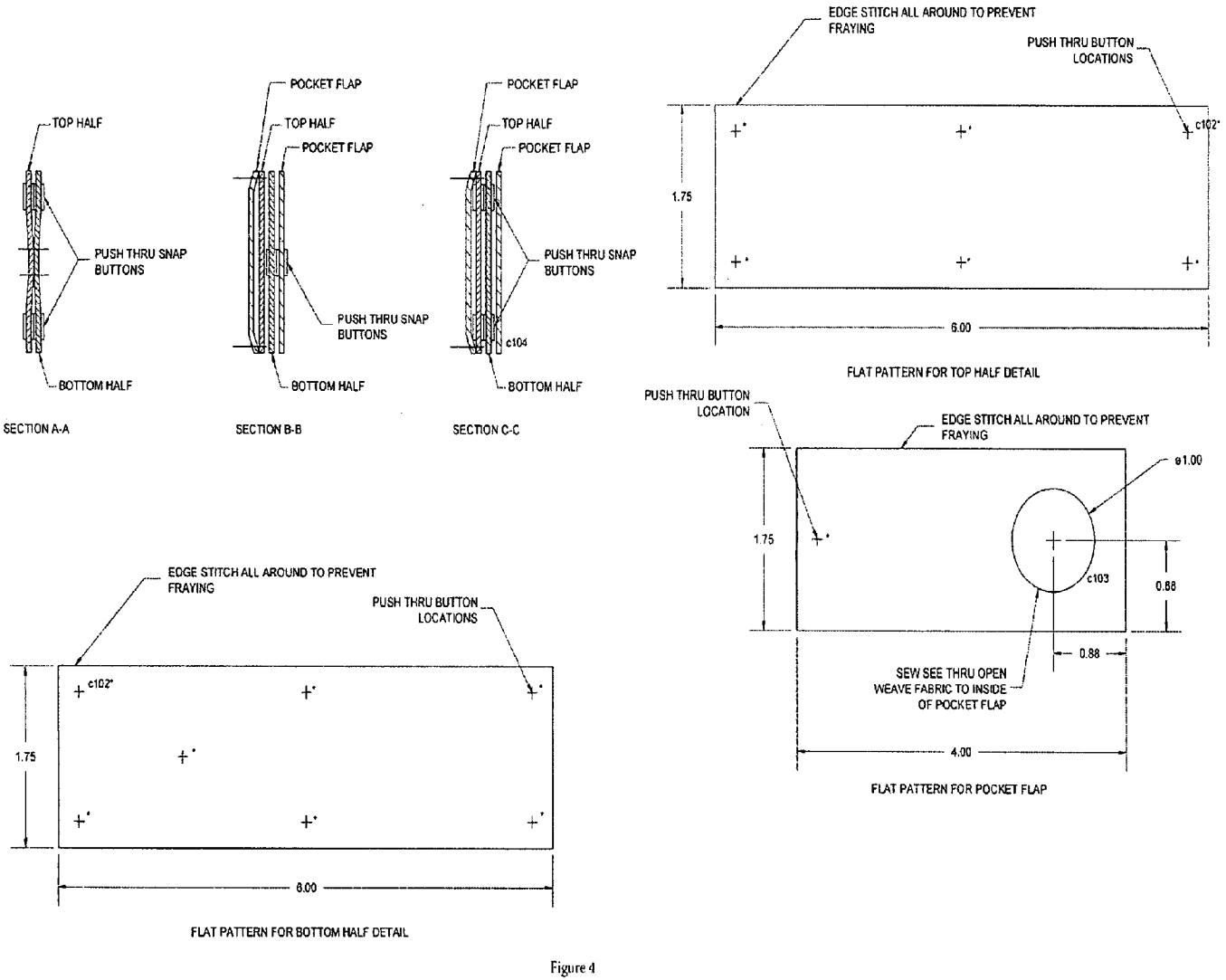
FIG. 4 represents back portion of the Jewelry Packaging Case for 12" necklace.

FIG. 4 represents back portion of the Jewelry Packaging Case for necklace (12") and it contains component 102 (102), seven snap fasteners and component 103 (c103), a pocket with clear plastic front to keep pendant and other small items. This also includes component 104 (c104) that represents the compacted view of the Kinkless necklace.

Figure 5:
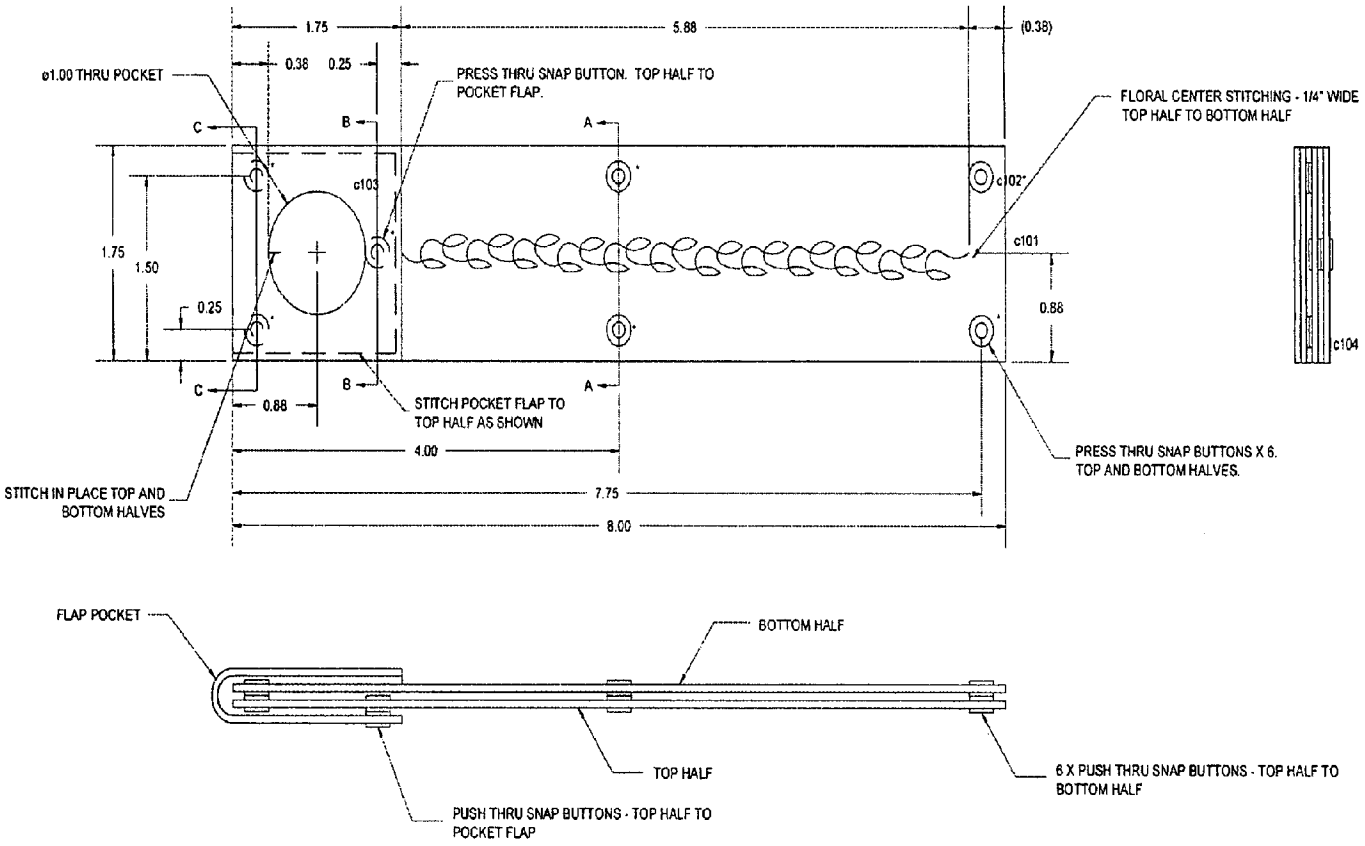
FIG. 5 represents front portion of the Jewelry Packaging Case for 16" necklace.

FIG. 5 represents front and side portions of the Jewelry Packaging Case for necklace (16") and it contains component 101 (c101) which is central stitch and Component 102 (c102), seven snap fasteners and component 103, a pocket with clear plastic front to keep pendant and other small items. This also includes component 104 (c104) that represents the compacted view of the Kinkless necklace.

Figure 6:
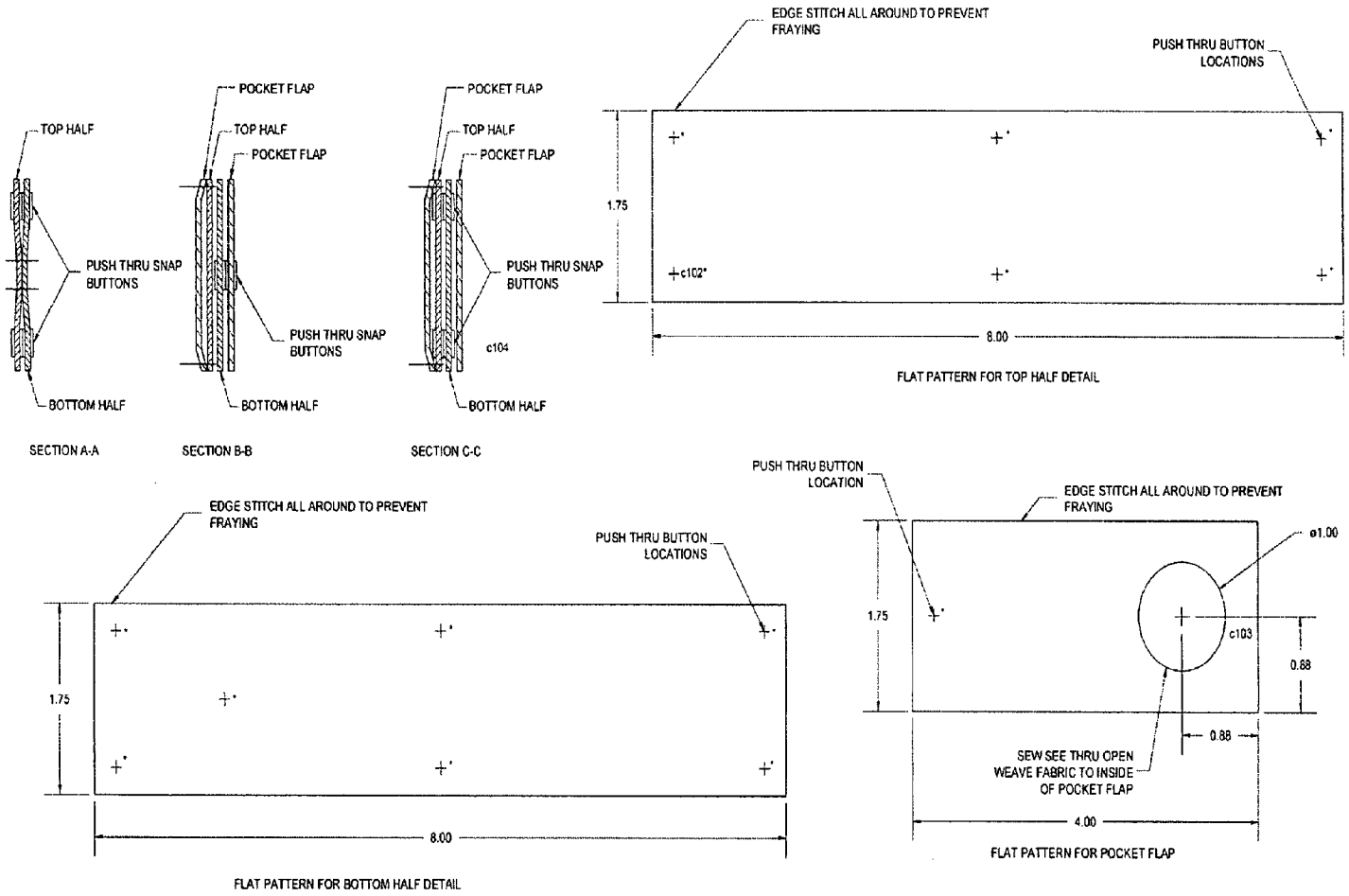
FIG. 6 represents back portion of the Jewelry Packaging Case for 16" necklace.
Figure 7:
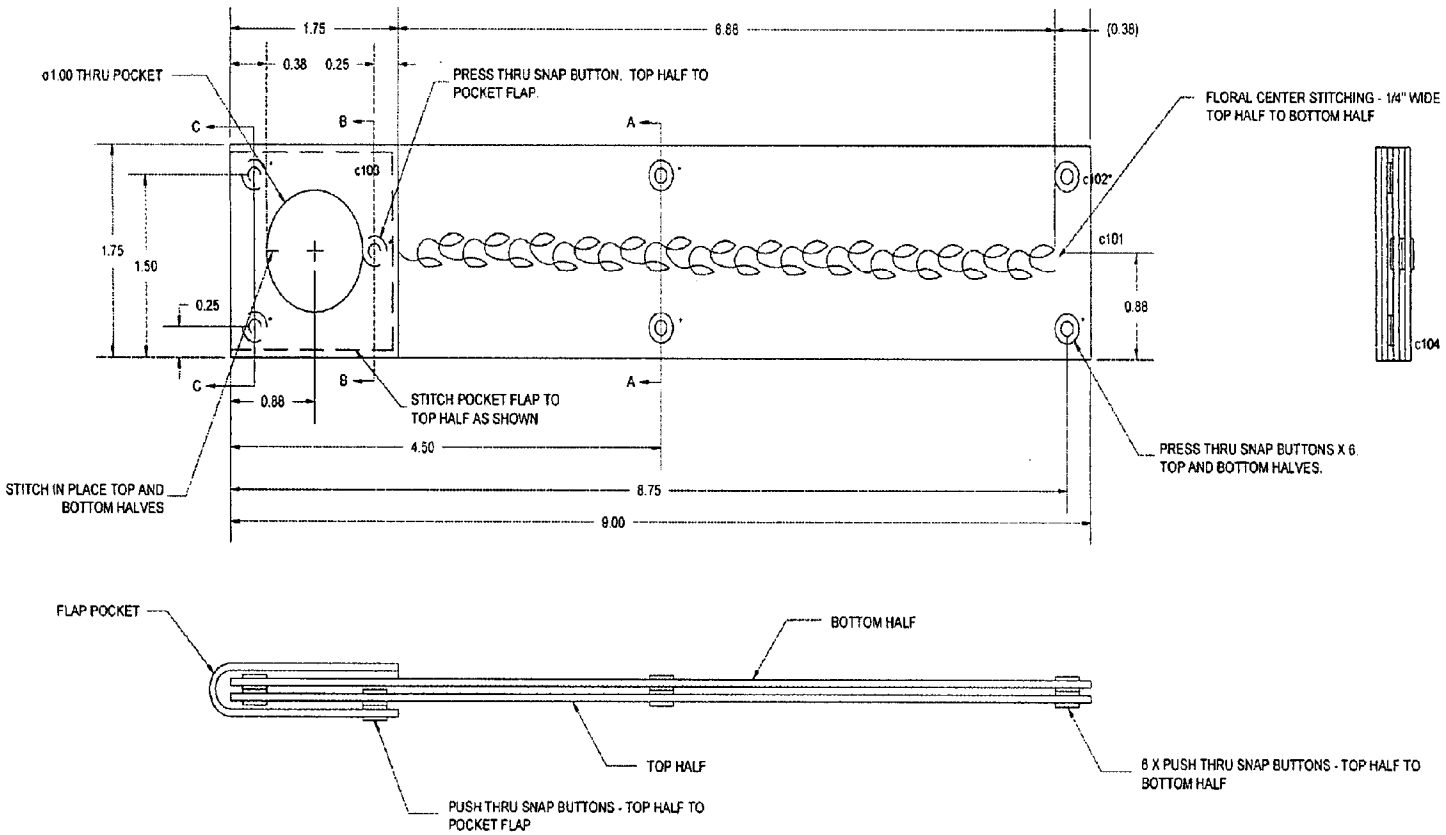
FIG. 7 represents front portion of the Jewelry Packaging Case for 18" necklace.

FIG. 6 represents back portion of the Jewelry Packaging Case for necklace (16") and it contains component 102 (c102), seven snap fasteners and component 103 (c103), a pocket with clear plastic front to keep pendant and other small items. This also includes component 104 (c104) that represents the compacted view of the Kinkless necklace FIG. 7 represents front and side portions of the Jewelry Packaging Case for necklace (18") and it contains component 101 which is central stitch and Component 102 (102), seven snap fasteners and component 103 (103), a pocket with clear plastic front to keep pendant and other small items. This also includes component 104 (c104) that represents the compacted view of the Kinkless necklace.

Figure 8:
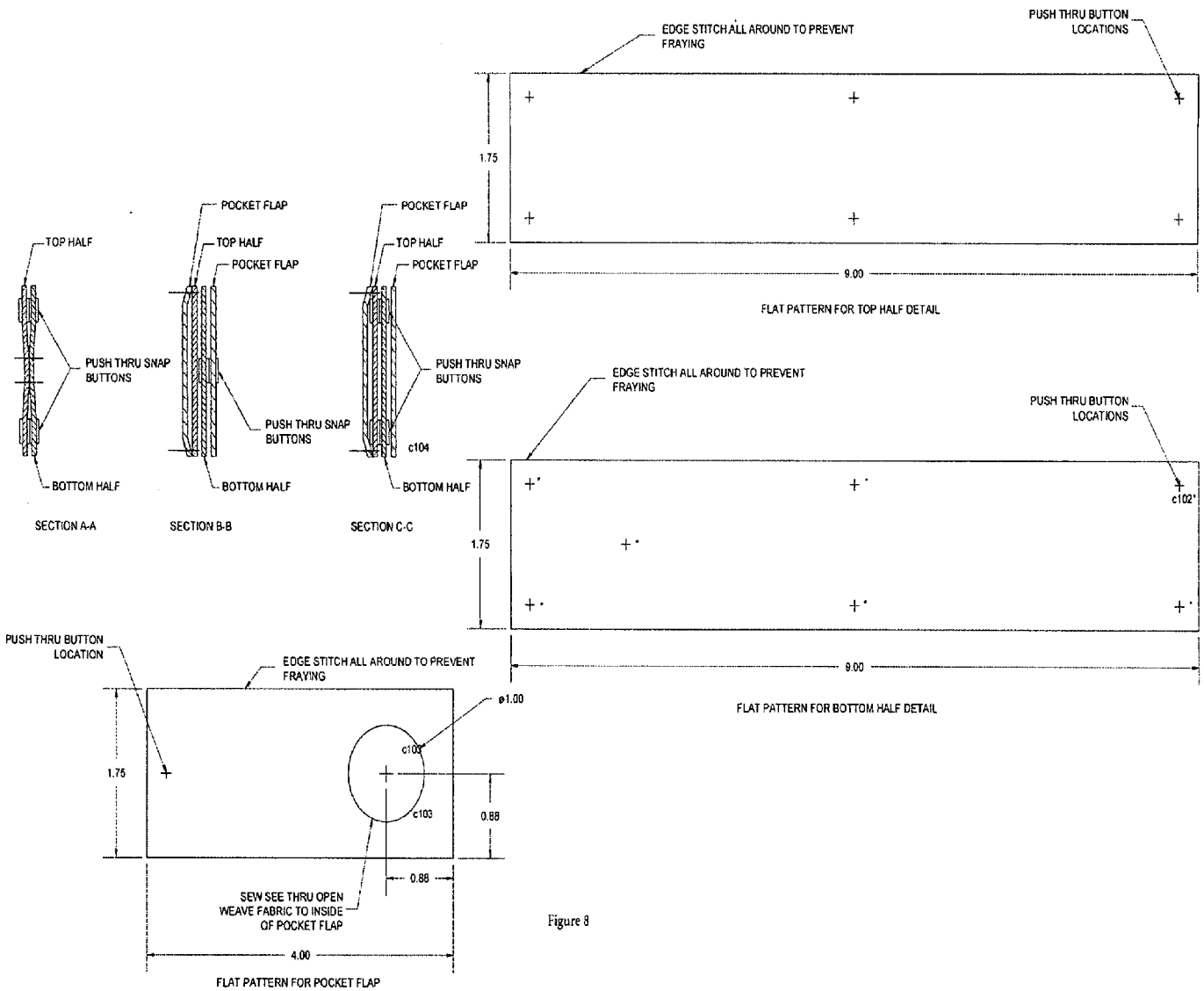
FIG. 8 represents back portion of the Jewelry Packaging Case for 18" necklace.
Figure 9:
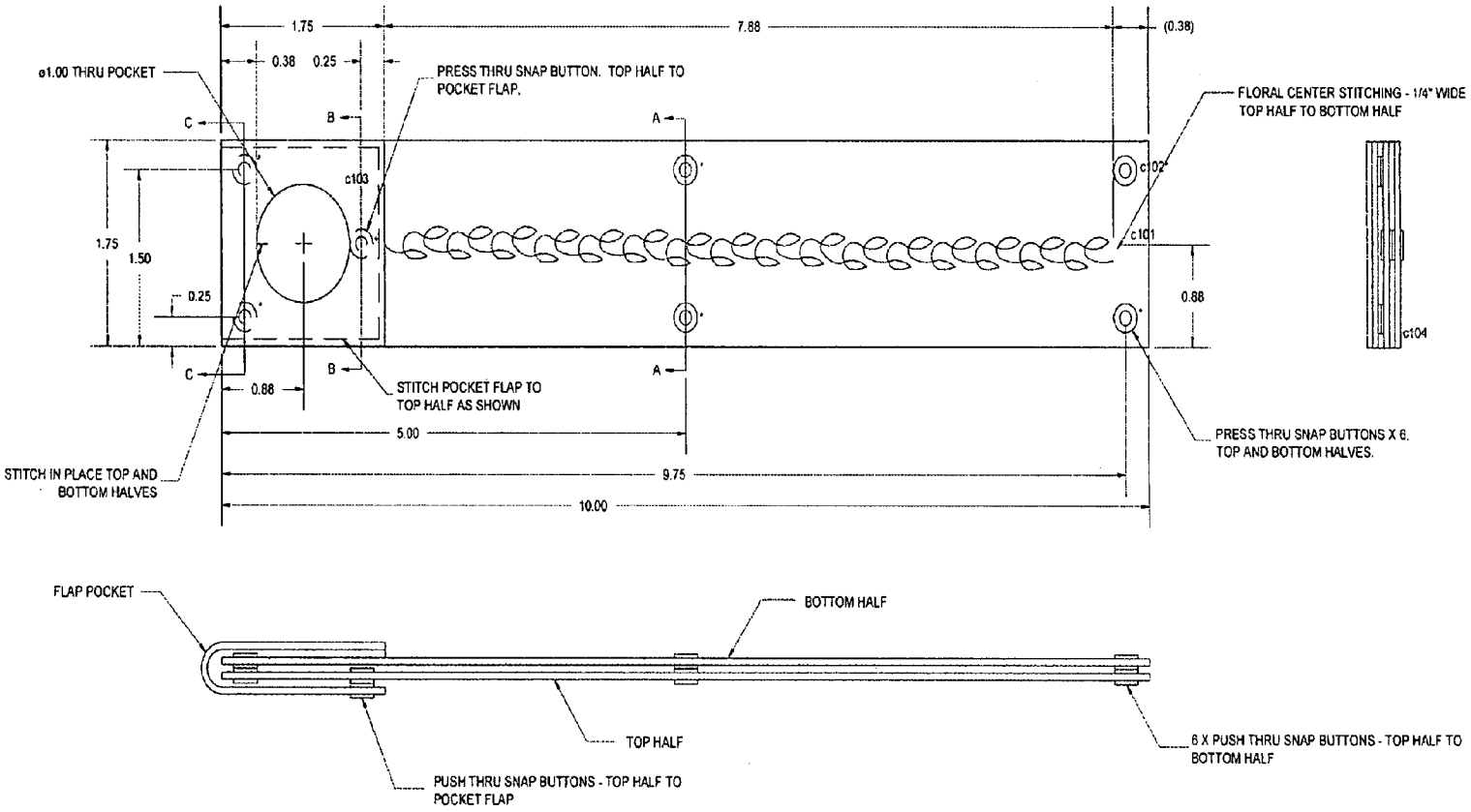
FIG. 9 represents front portion of the Jewelry Packaging Case for 20" necklace.

FIG. 8 represents back portion of the Jewelry Packaging Case for necklace (18") and it contains component 102 (c102), seven snap fasteners and component 103 (c103), a pocket with clear plastic front to keep pendant and other small items. This also includes component 104 (c104) that represents the compacted view of the Kinkless necklace FIG. 9 represents front and side portions of the Jewelry Packaging Case for necklace (20") and it contains component 101 (c101) which is central stitch and Component 102 (c102), seven snap fasteners and component 103 (c103), a pocket with clear plastic front to keep pendant and other small items. This also includes component 104 (c104) that represents the compacted view of the Kinkless necklace.

Figure 10:
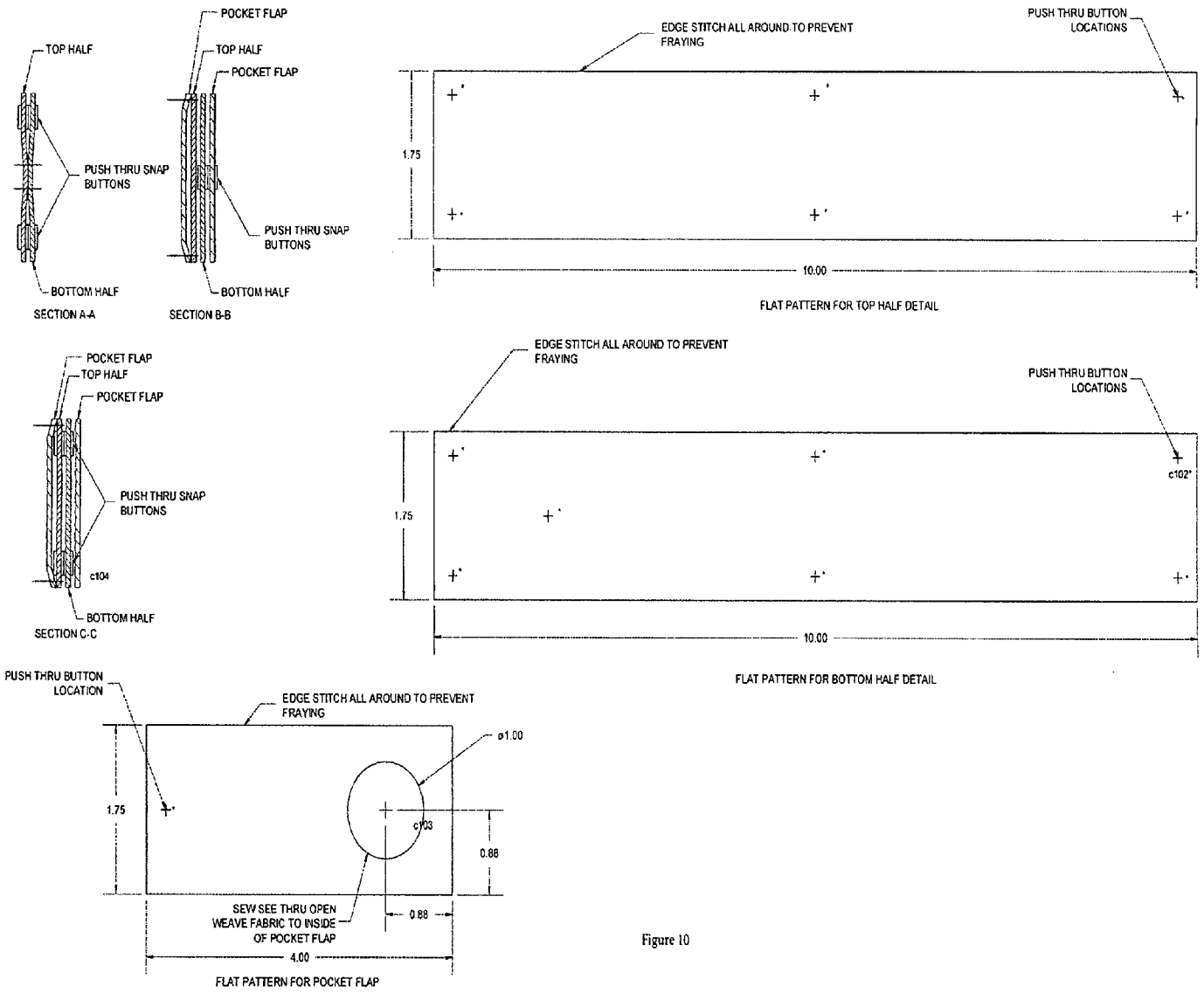
FIG. 10 represents back portion of the Jewelry Packaging Case for 20" necklace.

FIG. 10 represents back portion of the Jewelry Packaging Case for necklace (20") and it contains component 102 (102), seven snap fasteners and component 103 (c103), a pocket with clear plastic front to keep pendant and other small items. This also includes component 104 (c104) that represents the compacted view of the Kinkless necklace.

Figure 11:
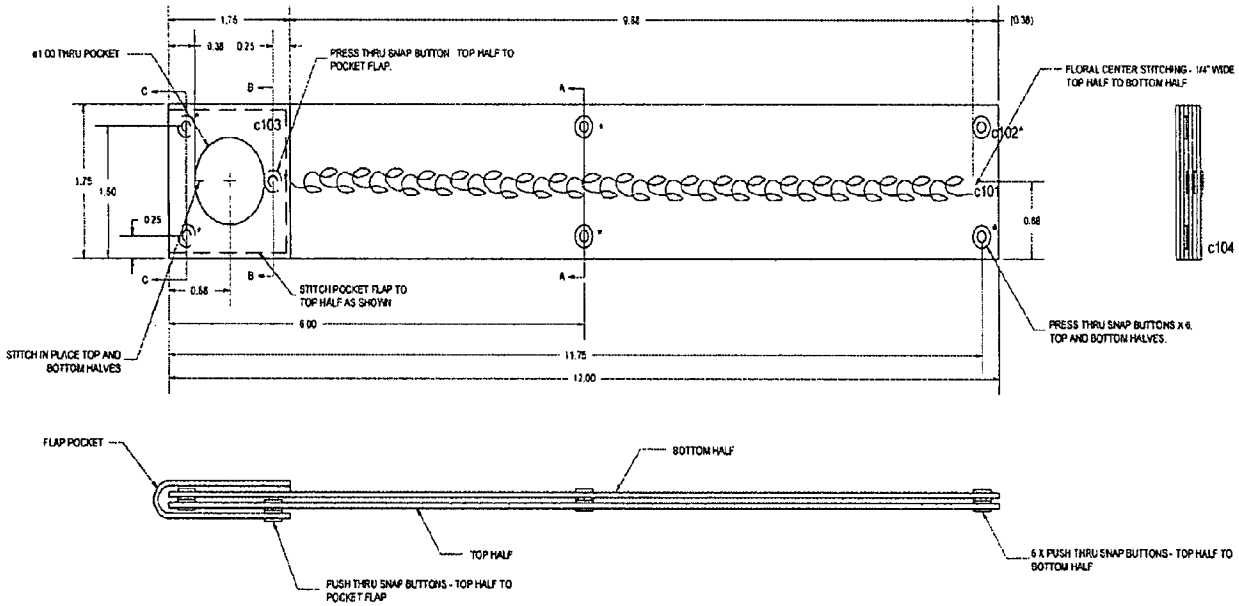
FIG. 11 represents front portion of the Jewelry Packaging Case for 24" necklace.

FIG. 11 represents front and side portions of the Jewelry Packaging Case necklace (24") and it contains component 101 (c101) which is central stitch and Component 102 (c102), seven snap fasteners and component 103 (c103), a pocket with clear plastic front to keep pendant and other small items. This also includes component 104 (c104) that represents the compacted view of the Kinkless necklace.

Figure 12:
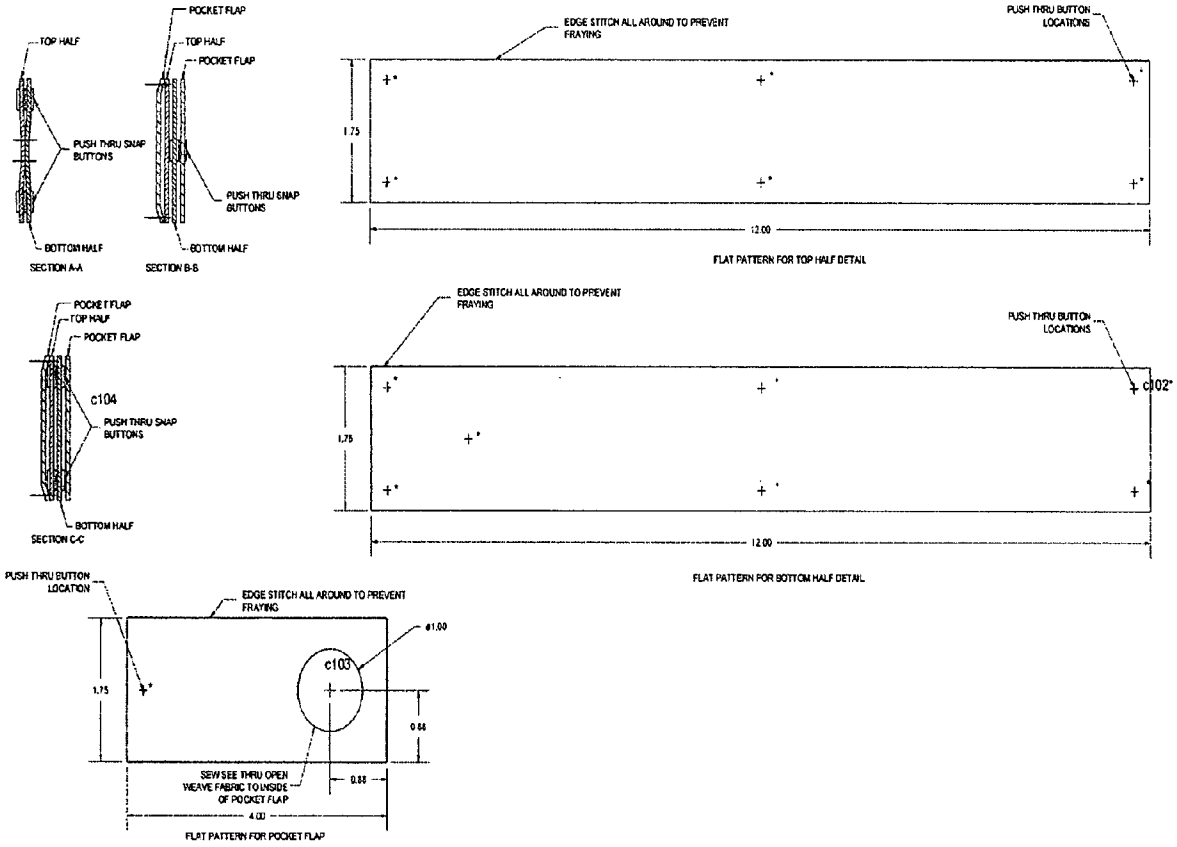
FIG. 12 represents back portion of the Jewelry Packaging Case for 24" necklace.

FIG. 12 represents back portion of the Jewelry Packaging Case for necklace (24") and it contains component 102 (c102), seven snap fasteners and component 103 (c104), a pocket with clear plastic front to keep pendant and other small items. This also includes component 104 (c104) that represents the compacted view of the Kinkless necklace.

Figure 13:
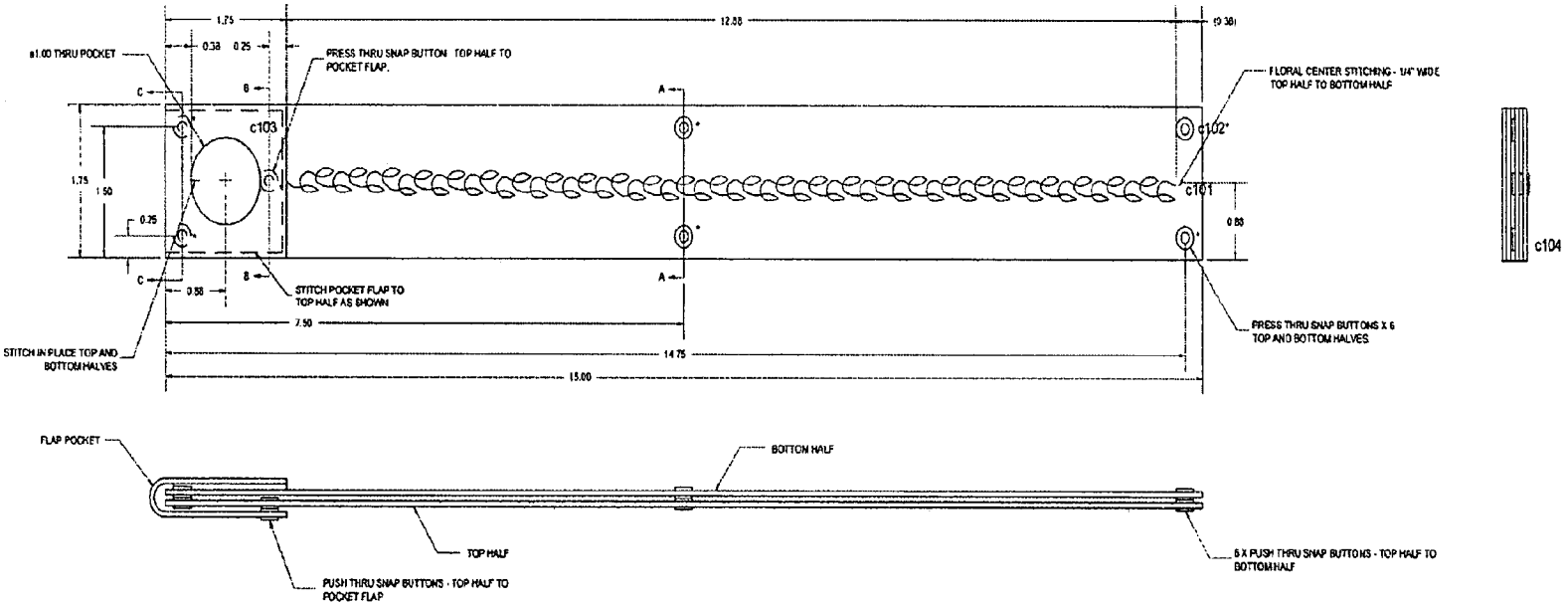
FIG. 13 represents front portion of the Jewelry Packaging Case for 30" necklace.

FIG. 13 represents front and side portion of the Jewelry Packaging Case for necklace (30") and it contains component 101 (c101) which is central stitch and Component 102 (c102), seven snap fasteners and component 103 (c103), a pocket with clear plastic front to keep pendant and other small items. This also includes component 104 (c104) that represents the compacted view of the Kinkless necklace.

Figure 14:
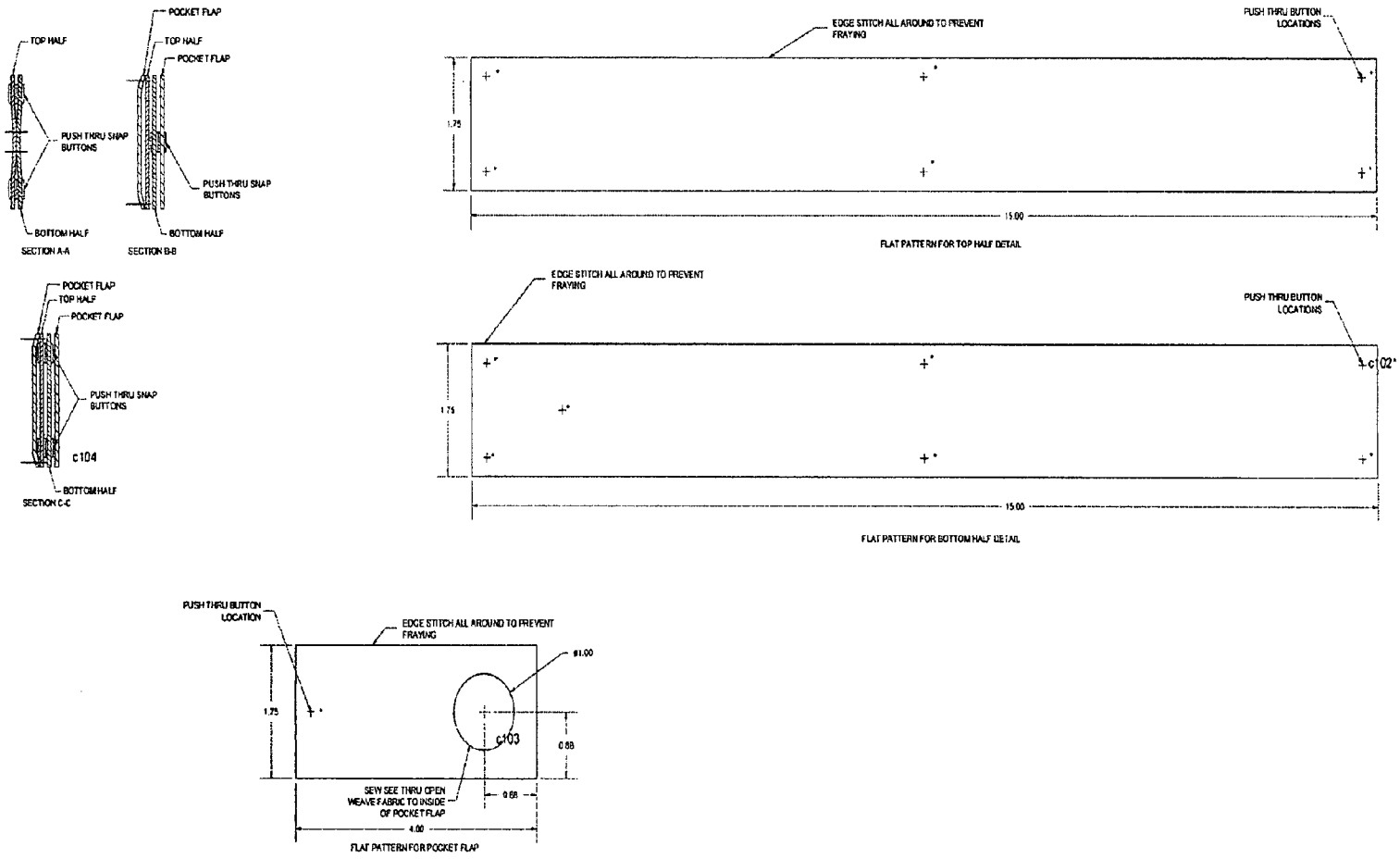
FIG. 14 represents back portion of the Jewelry Packaging Case for 30" necklace.
Figure 15:
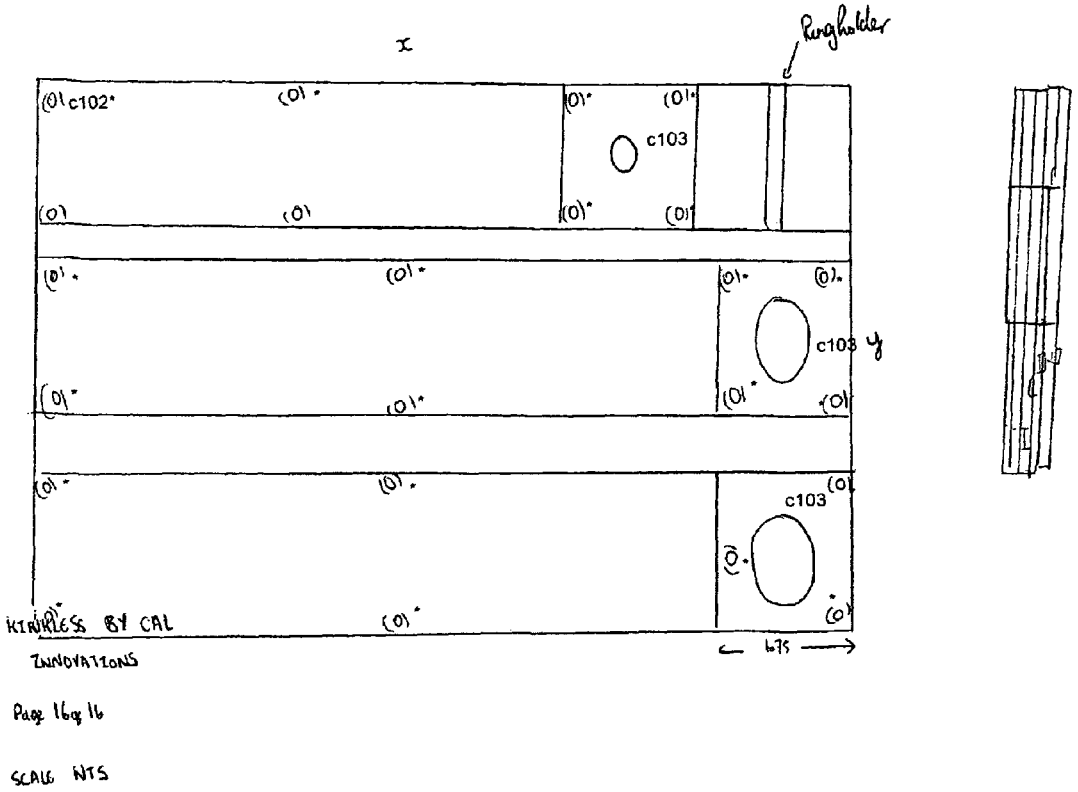
FIG. 15 represents front portion of the Jewelry Packaging Case for necklace and bracelets of varying lengths and, sizes.

FIG. 14 represents back portion of the Jewelry Packaging Case for necklace (30") and it contains component 102 (c102), seven snap fasteners and component 103 (C103), a pocket with clear plastic front to keep pendant and other small items. This also includes component 104 (c104) that represents the compacted view of the Kinkless necklace FIG. 15 represents front portion of the Jewelry Packaging Case necklace and it contains component 101 which is central stitch (3 sets) and Component 102 (c102), seven snap fasteners (3 sets) and component 103 (c103), a pocket with clear plastic front to keep pendant (3 sets) and other small items. This also includes component 104 (c104) that represents the compacted view of the Kinkless necklace.

DETAILED DESCRIPTION OF KINKLESS AND BEST MODE

For the smaller kinkless (Kinkless-6 and Kinkless-8), a bracelet or a child's necklace of 6 or 8 inches can be stored. It has a center stitch division to allow separation in the middle for the necklace to wrap around and then be closed in by snap fasteners. This unique design allows the necklace or bracelet to stay completely kink and tangle free.

For the larger kinkless (Kinkless-12, Kinkless-16, Kinkless-18, Kinkless-20), a necklace of 12, 16, 18, and 20 inches. It has a center stitch division to allow separation in the middle for the necklace to wrap around and then be closed in by snap fasteners. Kinkless also has a small pocket which goes from the front and wrap around to close off at the back to allow a pendant, earrings or rings to be enclosed in its structure kinkless and tangle free.

Please note that these lengths were derived from the standard lengths of bracelets/necklaces. If these lengths were to change, kinkless lengths can also be adjusted to meet needs e.g. 3 inches, 5 inches, 7 inches, 9 inches, 11 inches, 13 inches, 15 inches, 17 inches and so forth and any variations in between.

For Kinkless multiple this would allow variations of necklace and bracelets to be stored together. The lengths and widths would be dependent on the lengths of the necklace and bracelet in that combination and based on the principle design in the preceding Kinkless with a much wider base structure.

These inventions would be made of pacific or anti-tarnish cloth and sewn together as shown in the schematic diagrams using Serger stitched ends and perimeter as shown.

Additionally the back side of the pocket can be square instead of triangular and closed with a button/(s) as opposed to snap fasteners with a string loop.

The invention claimed is:

1. A jewelry storage device for preserving jewelry, the device having a rectangular and flexible substratum, the substratum comprising: at least a first and second separate planar sheets, each sheet having a first and second planar surfaces, wherein the first planar sheet and second planar sheet are stitched together along the middle of the respective planar sheets; wherein one of the planar sheet is larger than the other planar sheet; wherein the sheets are spaced apart from one another along the perimeter; wherein the device having at least four corner snap buttons fixed at four corners of the device where the corner snap buttons join the two planar sheets; the device further comprising a closure snap button located in line with the stitching in the middle of the two planar sheets to permit the device to close by folding an edge of the larger planar sheet.

2. The device of claim 1 wherein the substratum is manufactured of a cloth material.

3. The device of claim 1 wherein the substratum is manufactured of a plastic material.

4. The device of claim 1 wherein the substratum is manufactured of a material that can be folded.

5. The device of claim 1 further comprising a pocket on one of the two planar sheets.

6. The device of claim 1 further comprising a small pocket on one of the two planar sheets.

7. The device of claim 1 further comprising a small pocket with clear plastic front.

8. The device of claim 1 further comprising a small pocket made of plastic material.

9. The device of claim 1 wherein the corner and closure snap buttons are magnetic.

* * * * *